US005860175A

United States Patent [19]

Saiki

[11] Patent Number: 5,860,175

[45] Date of Patent: Jan. 19, 1999

[54] SELF UNFOLDING PORTABLE HANGING COT

[76] Inventor: Neal Saiki, 434 1/2 Hathway Ave., San Luis Obispo, Calif. 93405

[21] Appl. No.: 620,921

[22] Filed: Mar. 22, 1996

[51] Int. Cl.[6] ..... A45F 3/24

[52] U.S. Cl. ..... 5/111; 5/114; 5/127; 5/123

[58] Field of Search ..... 5/98.3, 111, 114, 5/120, 122, 123, 124, 127, 129

[56] References Cited

U.S. PATENT DOCUMENTS

| | | | |
|---|---|---|---|
| 947,545 | 1/1910 | Hohlfeld | 5/124 |
| 2,674,746 | 9/1954 | La Kaff | 5/116 X |
| 2,745,115 | 5/1956 | Reiss | 5/122 |
| 4,375,110 | 3/1983 | Murphy | 5/122 X |
| 5,109,556 | 5/1992 | Cook | 5/116 X |
| 5,170,520 | 12/1992 | Milliken | 5/98.3 |
| 5,673,444 | 10/1997 | Middendorf | 5/127 |

*Primary Examiner*—Michael F. Trettel

[57] ABSTRACT

A portable cot that consists of a tubular framework that supports a cloth bed on the perimeter. The framework and bed is suspended from above by hanging webbing. The tubular members of the framework are connected together by hinges that allow the framework to folded into a small bundle of tubes. The hinges and webbing are arranged so that framework is locked into a rigid bed when weighted and yet is allowed to fold when unweighted.

10 Claims, 8 Drawing Sheets

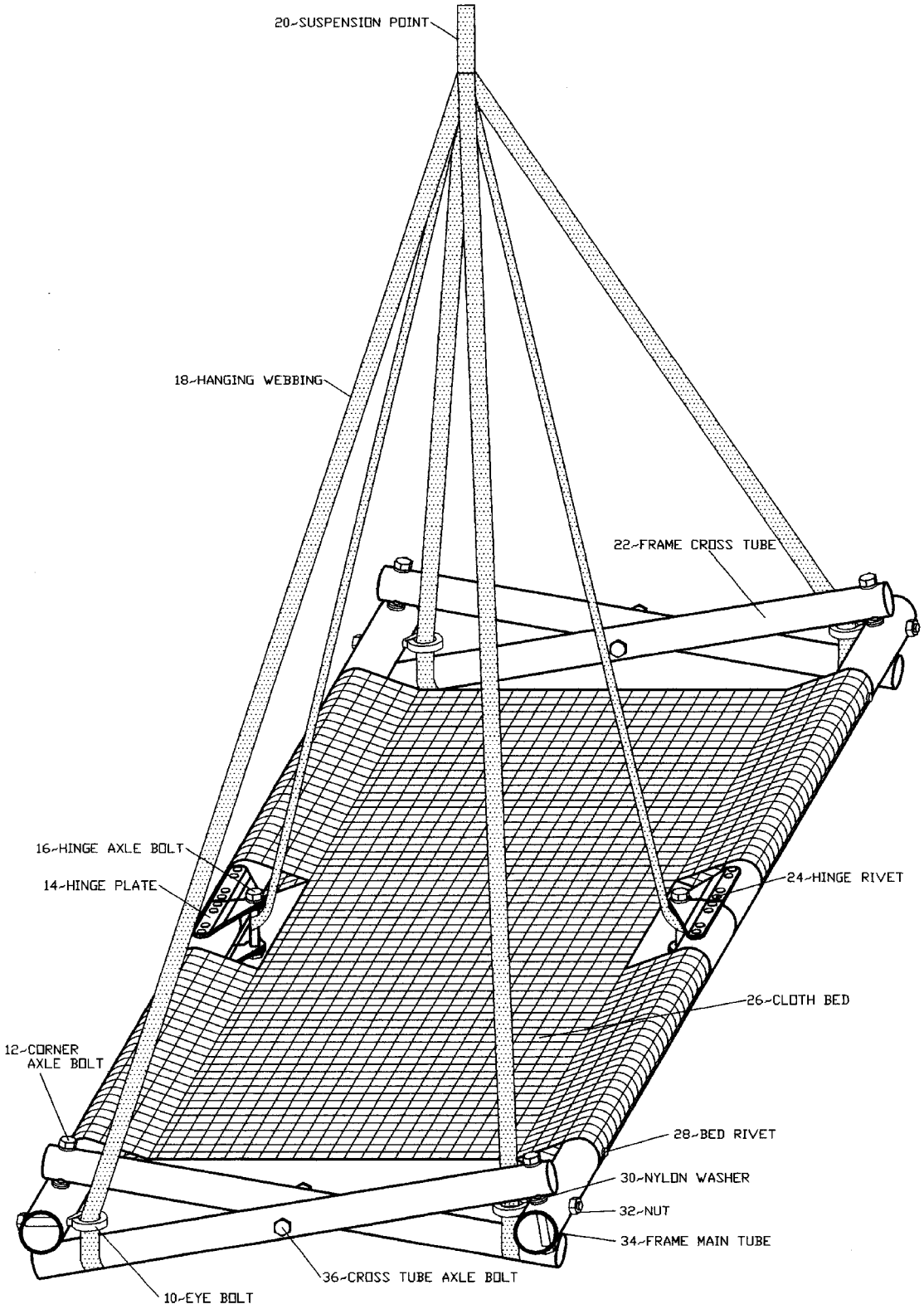
FIGURE 1 - INVENTION

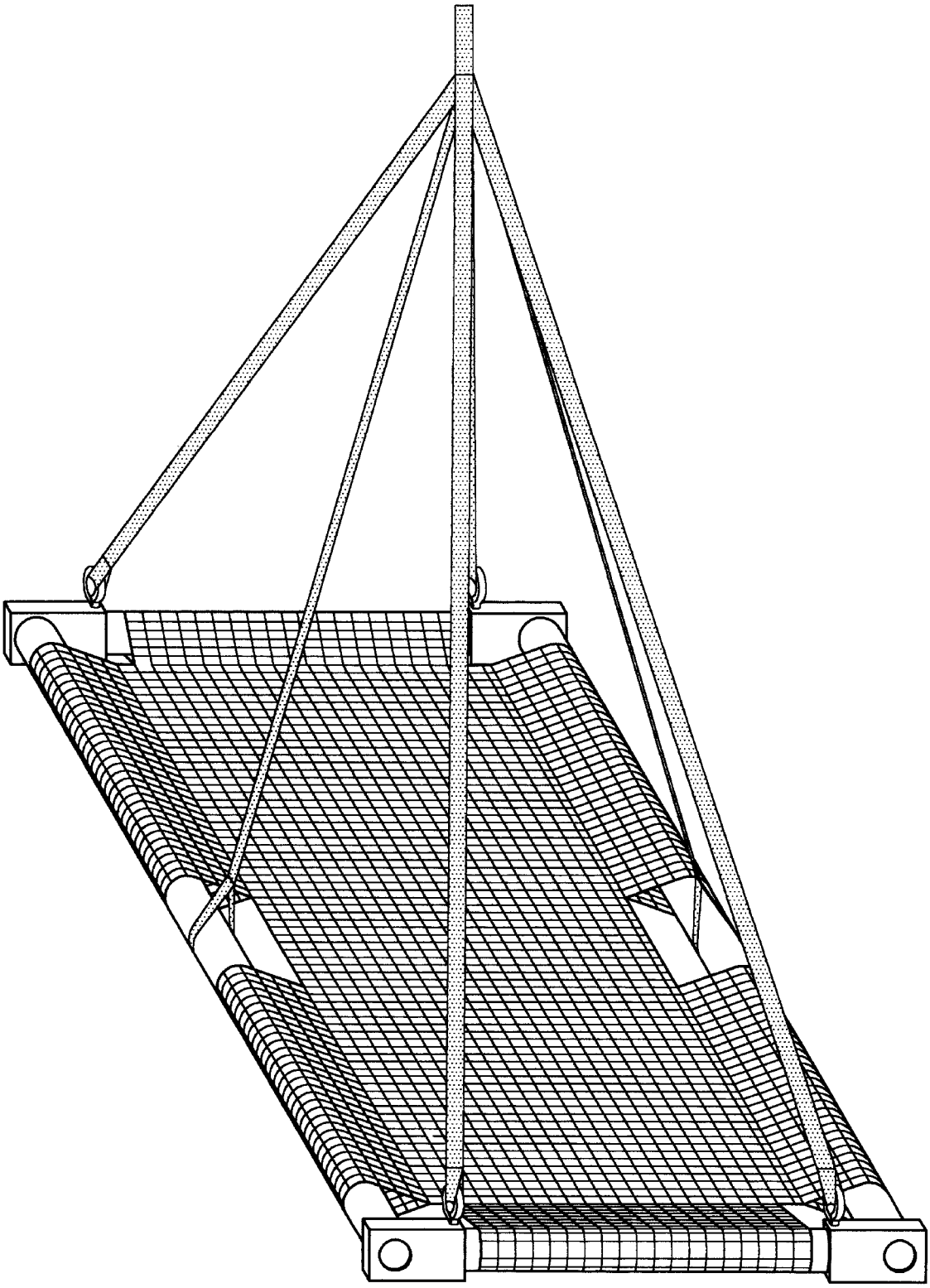
FIG. 2 - PRIOR ART PORTA-LEDGE

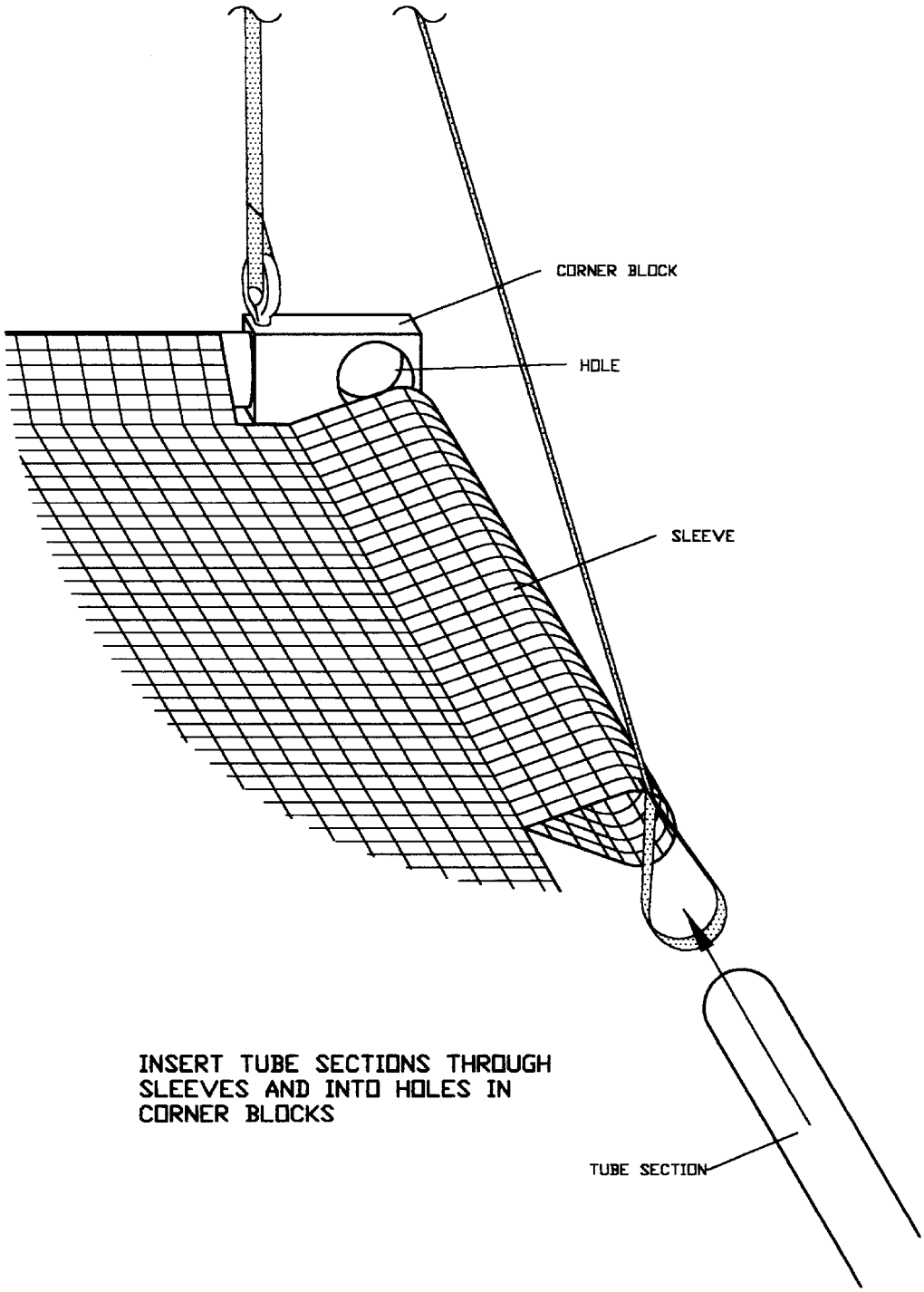
FIG. 3 - ASSEMBLY OF A PRIOR ART PORTA-LEDGE

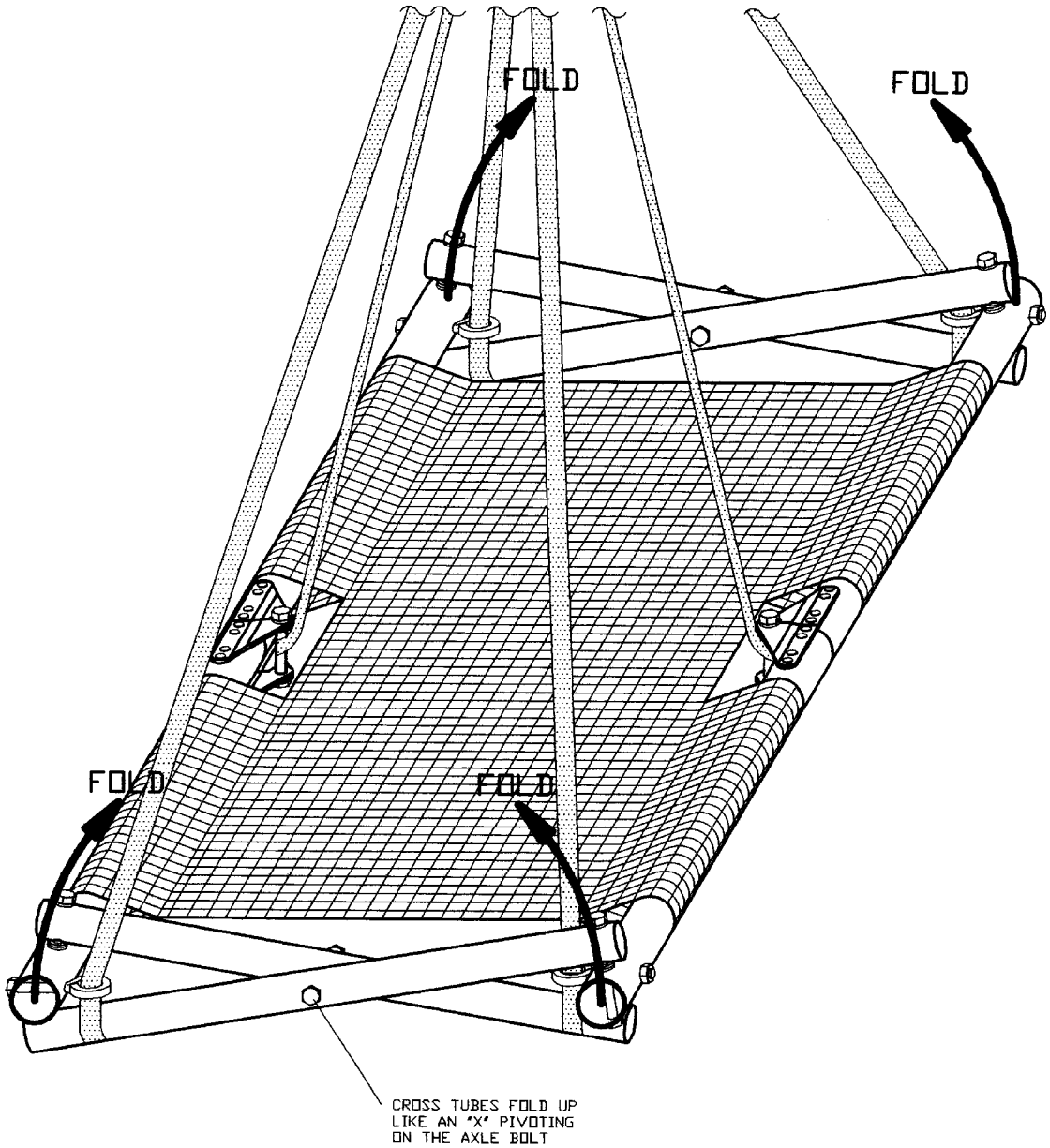
FIG. 4A - FOLD 1

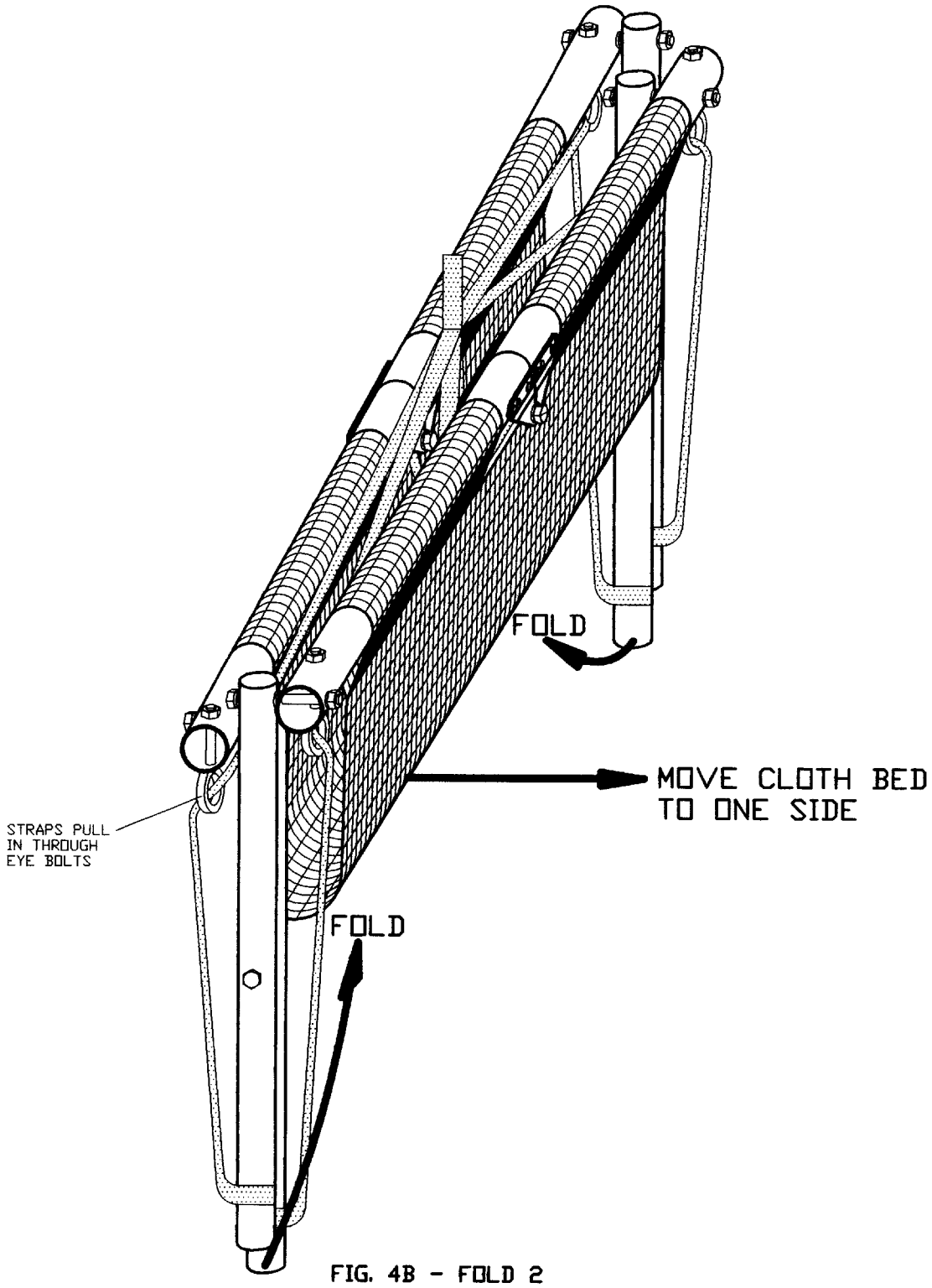
FIG. 4B - FOLD 2

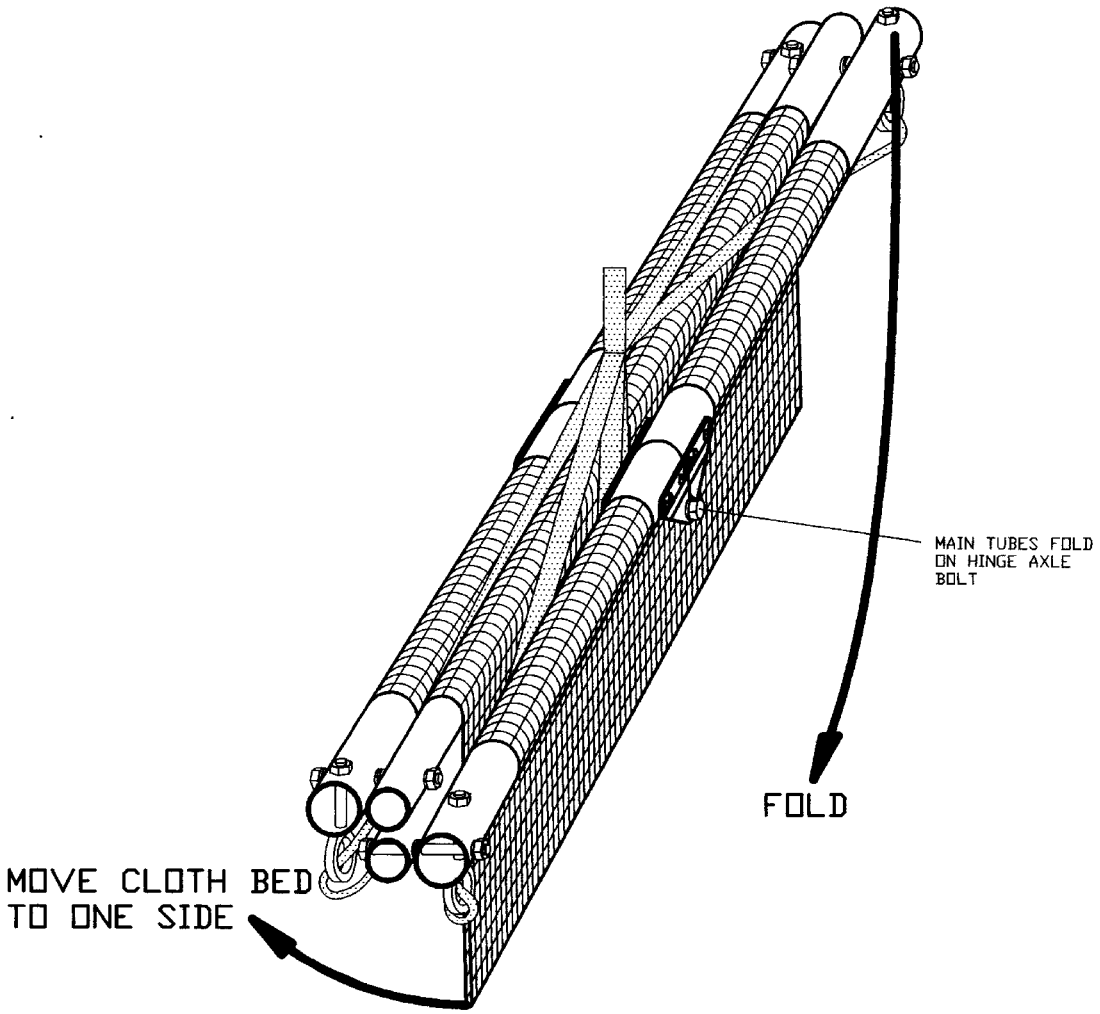
FIG. 4C - FOLD 3

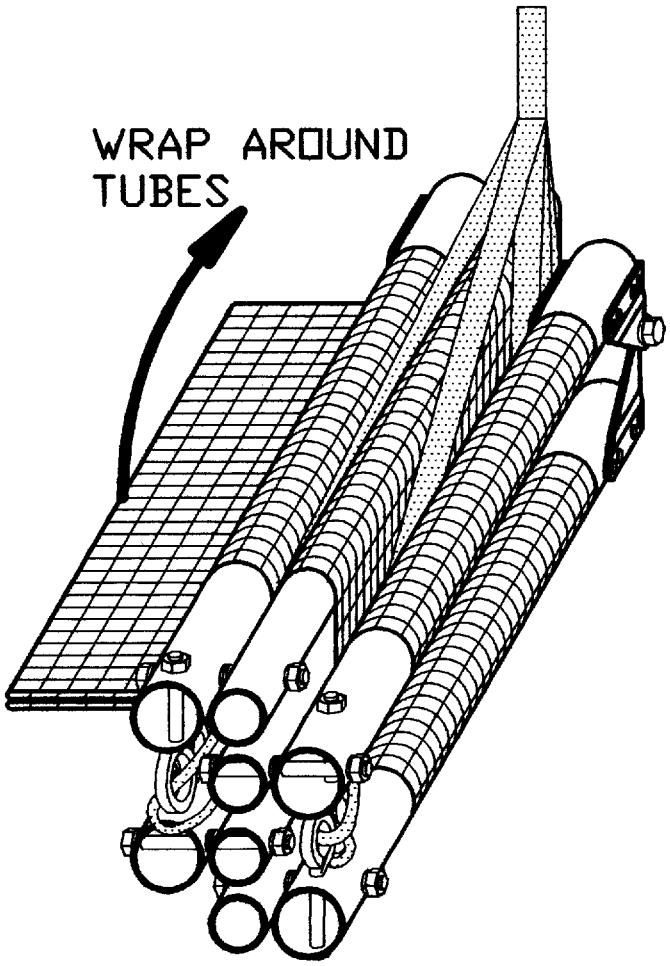
FIG. 4D - FOLD 4

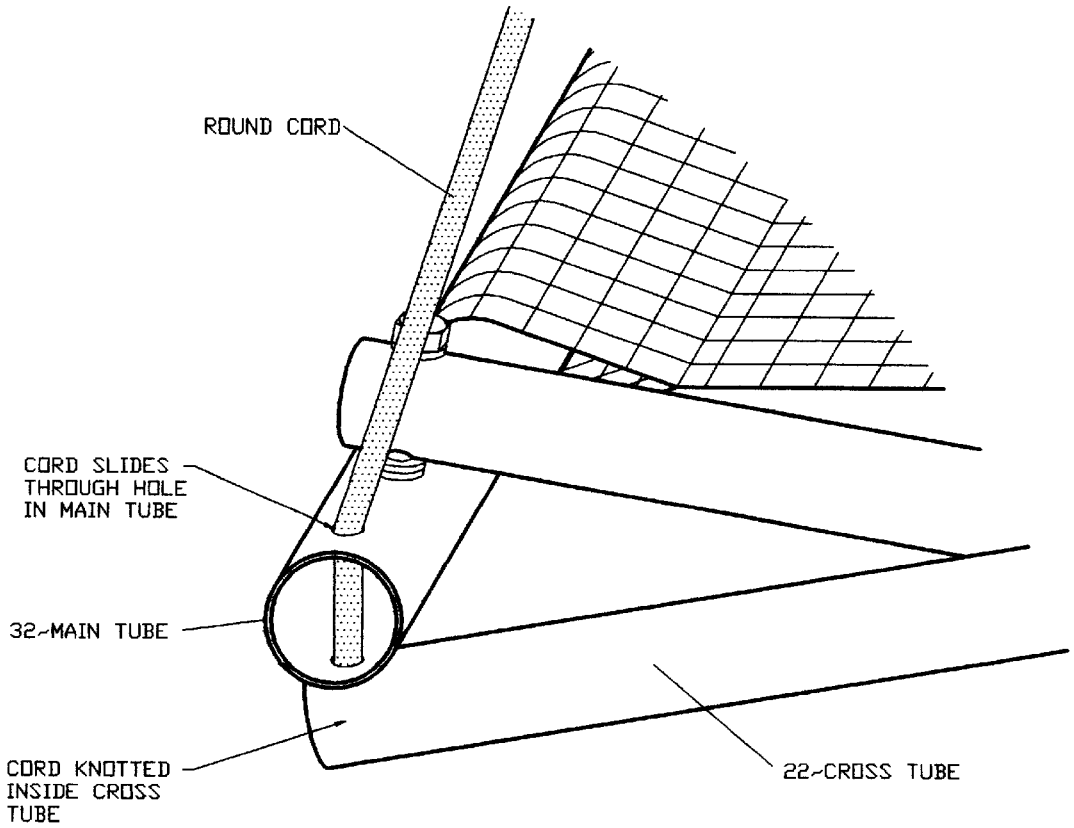
FIG. 5 - OPTIONAL HANGING ARRANGEMENT

SELF UNFOLDING PORTABLE HANGING COT

BACKGROUND—FIELD OF THE INVENTION

This invention relates to hanging portable cots that are used mainly, but not exclusively, for rock climbing.

BACKGROUND—DISCUSSION OF PRIOR ART

Over the last 30 years, the level of rock climbing has advanced to the point where multi-day ascents of shear rock faces are possible. Very often on these climbs, the rock face is so steep and relentless that there is no place to rest or sleep. At first climbers used hammocks to sleep in, but these are very constrictive around the body and require two points of attachment. Not to mention the rude awakening you could receive if you were to roll out of the hammock in the middle of the night. In order to overcome the shortcomings of hammocks, climbers developed rigid hanging cots which are commonly referred to as porta-ledges (short for portable ledge). These home-made porta-ledges were usually made from metal tubing and plumbing fittings. Today, one can choose between several commercially available porta-ledges.

All current porta-ledges are constructed basically the same. There are metal tubes which form the perimeter of a rectangular frame. Nylon cloth is then stretched in the frame to produce a flat bed. This bed is then suspended by four or six pieces of webbing which come together to a single point above the cot. The single anchor point makes it easy to hang.

The problem in designing porta-ledges is in how to make the frame rigid and yet easy to assemble and disassemble. All current porta-ledges use straight metal frame tubes which plug into each other with sleeve joints. Henceforth I'll refer to this design as the plug in tube design. The tubes are joined at the corners by corner pieces that have two holes at a right angle. The frame tubes are plugged into the corner pieces. In total there are six or eight separate pieces of tubing which must be plugged together in order to be assembled. There are several disadvantages to this design:

a) With up to eight separate frame tubes to plug together, it is difficult to assemble. You can imagine how difficult this can be when you are hanging in midair from the end of a rope. Also it is inevitable that the tube ends are going to get banged around and distorted while climbing. When this happens it makes it almost impossible to assemble.

b) The frame tubes are not fixed from rotating. At the corners, the tubes are free to rotate in the holes. This allows the ledge to twist along it's length forming the shape of a potato chip. More than one climber has cursed when they were flipped out of their porta-ledge when it "potato-chipped".

c) The only way to make satisfactory pieces is to machine them from solid blocks of aluminum. This makes for an expensive and heavy solution to the problem.

d) There is no good way to fold up the cloth bed and keep the tubes around the perimeter of the bed. Current designs require you to loosen the bed enough so that it can be fold it into several triangles. This is difficult to do while hanging in mid-air and makes for a large bulky package. It's bulky because the cloth is not neatly rolled, but rather folded several times.

e) The plug in tube design requires that the bed be tensioned after the frame is assembled. This is because it is impossible to slide the tubes in and out of their sleeves when the bed is tight and pulling the tubes together. Not only is this an inconvenient extra step, but it is also an added expense since there has to be a tensioning mechanism on the cloth bed.

OBJECTS AND ADVANTAGES

Accordingly, several objects and advantages of my invention are:

a) to provide a portable hanging cot whose assembly is greatly facilitated by the elimination of close tolerance joints which must be plugged together;

a) to provide a portable hanging cot whose assembly is so easy that it is practically self unfolding;

c) to provide a portable hanging cot which is rigid and that will resist being twisted into a "potato chip";

d) to provide a portable hanging cot that is less expensive by eliminating all machined metal pieces;

e) to provide a portable hanging cot that can be efficiently disassembled into a small package.

f) to provide a portable hanging cot that has a bed which is self tensioning.

g) By reducing the cost, other markets would be opened. An inexpensive portable hanging cot could be used for camping, backpacking, or even for lounging in the back yard.

Further objects and advantages are to provide a portable hanging cot which is light weight, inexpensive to manufacture, and easy to learn to use. Still further objects and advantages of my invention will become apparent from a consideration of the drawings and ensuing description.

DRAWING FIGURES

In the drawings, closely related figures have the same number, but different alphabetic suffixes.

FIG. 1 shows a perspective view of my invention.

FIG. 2 shows a perspective of a prior art porta-ledge.

FIG. 3 shows the assembly instructions for a prior art porta-ledge.

FIGS. 4A to 4D shows the steps to fold the portable hanging cot into it's compact package.

FIG. 5 shows an alternate method of hanging the portable hanging cot from round cord rather than with webbing.

List of Reference Numerals in Drawings

| | |
|---|---|
| 10 eye bolt | 12 corner axle bolt |
| 14 hinge plate | 16 hinge axle bolt |
| 18 hanging webbing | 20 suspension point |
| 22 frame cross tube | 24 hinge rivet |
| 26 cloth bed | 28 bed rivet |
| 30 nylon washer | 32 nut |
| 34 frame side tube | 36 cross tube axle bolt |

DESCRIPTION—FIGS. 1 AND 4

A typical embodiment of the self unfolding portable hanging cot is illustrated in FIG. 1. The cot can be segregated into three general assemblies: a cloth bed, a metal tube frame, and lastly a system of hanging webbing.

In this embodiment, the frame is made up of eight sections of metal tubing. Aluminum tubing being the preferable material due do it's high strength to weight ratio and corrosion resistance. The long side of the frame consists of two frame side tubes 34 running lengthwise. The side tubes are made from two sections of tubing of equal length and are connected by a hinge in the middle. The hinges are aligned so that they lock the tubes out straight when the bed is open. The tension of the cloth bed keeps the hinges locked. The hinges consist of two hinge plates 14 and a hinge axle bolt 16. The hinge plates 14 are made from plate aluminum. The hinges are connected to the side tubes 34 by hinge rivets 24. The hinge axle bolt 16 is a threaded bolt which is retained by a nut 32. The short side of the frame consists of two frame cross tubes 22. These cross tubes 22 run perpendicular to the side tubes 34 and form the short sides of the rectangular frame. The cross tubes 22 are connected to the main tubes 34 with a corner axle bolt 12 which is retained by a nut 32. The corner axle bolt is vertical which allows the cross tubes 22 to pivot in the horizontal plane. The two cross tubes 22 are then connected together by a cross tube axle bolt 36 which is drilled slightly to one side of the midpoint of the cross tube 22. This forms a hinging "X" shape with the hinge offset to one side. The offset drilling allows the tube ends to be even when the frame is folded into the smallest package. The FIG. 1 clearly shows the arrangement of side tubes 34 and cross tubes 22.

The cloth bed 26 is sewn from nylon canvas or a similar material. The long sides are sewn into a tube and are slipped over the long side tubes 34. There is a hole in the sleeves for the side tubes hinge mechanisms. The cloth is retained on the tubes by a rivet 28 or similar fastener at each corner of the rectangular bed.

The system of hanging webbing is made from six pieces of flat nylon webbing which support the frame at the four corners and in the middle of the long sides of the rectangle. It is preferable to use webbing since it is easy to sew and can also incorporate adjustable buckles which allow the length of the webbing to be adjusted. The six straps are gathered together at a suspension point 20 where the ledge can hang from. At the suspension point there is a loop of webbing which allows a carabiner to be clipped into the suspension point 20.

The lower ends of the hanging webbing are fastened to the frame. In the corners, the webbing is sewn into a loop and placed over the lower legs of the cross tubes. The webbing is held in place on the cross tubes by a fastener or rivet which keeps the loop from sliding on the cross tube. Each corner webbing is guided by an eye bolt 10 which projects horizontally from the side tube. The webbing is allowed to slide freely through the eye bolt 10. The hanging webbing also supports the cot at the midpoint of the long sides of the rectangle. These pieces of webbing are connected to the hinge axle bolt 16. The axle bolt 16 is placed through the looped end of the hanging webbing.

An additional embodiment is shown in FIG. 5. In this case the nylon webbing has been replaced with round cord. The cord is threaded through a hole in the side tube and fastened to the lower cross tube. This has the advantage of eliminating the eye bolt 10. The basic mechanism that opens and closes the ledge is unaffected by use of various materials for the hanging webbing. The webbing could also be routed in many different ways without effecting the function. The key is to use the tension of the webbing to lock the cross tube 22 in place.

There are other possibilities with regard to the frame and hinging mechanisms. The frame tubes could easily be made from steel, carbon-fiber, or other high strength materials and may be of various cross sectional shape. The hinges that join the side tubes 34 could be of any number of configurations. Almost any hinge type could be utilized. Even a plug in coupling could be used although this would negate much of the ledge's convienece. Hinge attachment could also be accomplished by means of screws, welding, or even bonding.

From the description above, a number of advantages of my self unfolding portable hanging cot become evident.

a) All of the frame tube are hinged together so that there are no separate pieces. Thus unfolding of the cot very easy and there are no loose pieces.

b) No complicated machined or cast metal pieces are required. The only materials required to construct the cot are either tubing, sheet metal, or pre-made hardware.

c) The design is flexible in that either flat webbing or round cord can be used for the hanging straps.

Operational—FIGS. 4A–4D

The uniqueness of this invention is in how the frame folds up into a very small package. The way in which all of the tubes fold up onto each other is very un-obvious. I have broken down the folding of the cot into four steps which are described in FIGS. 4A–4D.

FIG. 1 shows the frame in the flat position. When the bed is folded out flat the weight of the tubes keeps the frame unfolded flat. As weight is put on the bed, the hanging straps pull the lower cross tubes 22 such that the bed is locked into the flat position.

FIG. 4A shows the first fold. The side tubes 34 are lifted up and each frame half pivots on the axle bolts 36. Lifting the side tubes causes the hanging webbing 18 to be pulled through the eye bolts 10. The frame ends up folded in half with the cross tubes 22 hanging down as shown in FIG. 4B.

FIG. 4B shows the second fold. With the frame folded in half, the bed is free to hang down in the middle. For the next fold, the hanging bed cloth is pushed to one side and the cross tubes 22 are folded inwards. The cross tubes pivot on the cross tube axle bolts 12 that are at the ends of the side tubes 34.

FIG. 4C shows the third fold. Notice that all of the tube ends are flush at this point. This is accomplished by the fact that the pivot axle 36 in the cross tubes in not exactly at the midpoint of the cross tubes 22. This compensates for the fact that the corner axle bolts 12 are staggered. For the next fold, the cloth bed is again pushed to the side in order to make room for the folding tubes. The frame is folded in half along the main hinge axle bolt 16.

The fully folded configuration is shown in FIG. 4D. At this point, the cloth bed 26 is wrapped around the tubes in a very neat fashion. In this folded state, the frame is very compact and easy to transport.

From the operational description above, several advantages become obvious.

a) The arrangement of the hanging straps locks the frame out flat. The more weight placed on the bed, the more the frame is locked out flat. Since the tubes cannot rotate, the frame resists the tendency of existing ledges to "potato chip".

b) Offset drilling of the holes in the cross tubes 22 allow all of the tube ends to be flush when in the folded configuration. Although this feature is not necessary for operation, this makes for the smallest possible package.

c) When folding the cot, the hanging webbing 18 being pulled through the eye bolts 10 causes the hanging webbing 18 to be pulled straight along the tubes and folded neatly with the frame. Existing ledge designs have the hanging straps free to be folded into a tangled mess.

d) The unique arrangement of the folding tubes allows the use of a hinge at the midpoint of the side tubes. This is possible because the tubes are rotated upon unfolding so that the hinges are oriented in opposition to lock out straight. However when the frame is folded, the tubes rotate the main hinge so that the align in the same direction so that the frame can be folded.

Summary, Ramifications and Scope

Accordingly, the reader will see that the self unfolding hanging cot of this invention is a great advancement over traditional designs. The cot can be easily folded into a small circular bundle of tubes and unfolding it is even easier. The single hanging point makes it easy and convenient to suspend from almost anywhere. Furthermore, the self unfolding hanging cot has the additional advantages that:

The frame is simple and inexpensive to manufacture. Unlike existing designs, no machined metal pieces are required.

The frame folds out and locks into a rigid and flat bed. The cloth is automatically stretched taught on the frame.

Assembling the frame is a quick and easy process since all of the joints are hinged. No trying to align tubes in small holes.

The frame and cloth folds neatly into the smallest possible package. Even the hanging cords are automatically folded with the frame.

By reducing cost and complexity, other markets would be opened. An inexpensive portable hanging cot could be used for camping, backpacking, or even for lounging in the back yard.

By making a collapsible cot that is easy to unfold, other markets would be opened. A great application would be for rescue work where portability and easy of use is of prime concern. The self unfolding hanging cot could be easily stored inside a helicopter and lowered on a rope for transporting someone who needs to be transported in a prone position.

Although the description above contains many specifications, these should not be construed as limiting the scope of the invention but as merely providing illustrations of some of the presently preferred embodiments of this invention. For example, the tubes could be of any cross sectional shape, such as square or rectangular. The hanging straps could be routed differently as long as they pull the frame out flat when unfolded and lock the frame into position.

Thus the scope of the invention should be determined by the appended claims and their legal equivalents, rather than by the examples given.

I claim:

1. In a hanging cot comprising:

a) a rectangular bed of flat material, b) a hanging means which provides support from above, said hanging means is comprised of at least four thin highly flexible members, for suspending said cot, and creating a hanging tension on said highly flexible members, c) a pair of side members to which said rectangular bed is attached, d) an unfolding means for utilizing the hanging tension on said highly flexible members to automatically unfold and tension said rectangular bed by spreading said side members apart and holding them rigidly apart in a parallel position, e) the improvement wherein said unfolding means for the automatic unfolding and tensioning of said rectangular bed requires no manual assembly or positioning of any pieces.

2. The hanging cot of claim 1 wherein said thin highly flexible members have a means for adjusting their length.

3. The cot of claim 1 wherein said unfolding means consists of a plurality of transverse member assemblies in which each said transverse member assembly is comprised of two cross members, said cross members are pivoted together near their midpoints forming an X-configuration, each said cross member having an upper end and a lower end, both said cross members are attached at their upper ends to said side members, and both said cross members are attached at their lower ends to a said thin highly flexible member, the pivot near the midpoint of the cross members allows a folding process when tension on said highly flexible members is removed, said folding process allows the X-configured cross members to scissor upward until said cross members are approximately parallel and vertical.

4. The hanging cot of claim 3 wherein the attachment between said side member and said cross members is a rigid right angle joint.

5. The hanging cot of claim 3 wherein there are two, three, or four of said transverse member assemblies.

6. The hanging cot of claim 3 wherein said side members and said cross members are constructed of tubing.

7. The hanging cot of claim 3 wherein the attachment between each said side member and each said cross members is a pivot, the pivot between each said side member and each said cross members adds a second stage to the folding process, wherein the first stage scissor said X-configured cross members upward until said cross members are approximately parallel and vertical, the second stage folds the parallel and vertical cross members upward until they are approximately parallel to the side members.

8. The hanging cot of claim 7 wherein said side members are divided into multiple sections and are endwise connected together by disconnectable means.

9. The hanging cot of claim 8 wherein said disconnectable means is a sleeve joint.

10. The hanging cot of claim 7 wherein said side members are divided into multiple sections and are endwise connected together by hinging means, the hinging means between the sections adds a third stage to the folding process, wherein the first stage scissors said X-configured cross members upward until said cross members are approximately parallel and vertical, the second stage folds the parallel and vertical cross members upward until they are approximately parallel to the side members, the third stage folds said side members at the hinged connections.

* * * * *